US006702260B2

(12) United States Patent
Gourdain et al.

(10) Patent No.: US 6,702,260 B2
(45) Date of Patent: Mar. 9, 2004

(54) INSTALLATION AND METHOD OF VENTING THE WASTE GASES OF AIR DISTILLATION OR LIQUEFACTION UNITS

(75) Inventors: Daniel Gourdain, Lagny sur Marne (FR); Jean-Marc Peyron, Creteil (FR)

(73) Assignee: L'Air Liquide-Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 111 days.

(21) Appl. No.: 09/981,733

(22) Filed: Oct. 19, 2001

(65) Prior Publication Data

US 2002/0046767 A1 Apr. 25, 2002

(30) Foreign Application Priority Data

Oct. 19, 2000 (FR) ..... 00 13382

(51) Int. Cl.[7] ..... B01F 3/04
(52) U.S. Cl. ..... 261/16; 261/117; 366/107
(58) Field of Search ..... 261/16, 76, 115, 261/117; 366/107

(56) References Cited

U.S. PATENT DOCUMENTS

| | | | | |
|---|---|---|---|---|
| 3,554,228 | A | * | 1/1971 | Schneider |
| 3,936,382 | A | * | 2/1976 | White |
| 4,208,195 | A | * | 6/1980 | Etcheverria et al. |
| 4,738,695 | A | * | 4/1988 | Carr et al. |
| 5,049,317 | A | * | 9/1991 | Kiske et al. |
| 5,146,756 | A | | 9/1992 | Lavin |
| 5,481,880 | A | | 1/1996 | Guillard et al. |
| 5,865,041 | A | * | 2/1999 | Agrawal et al. |
| 2002/0040641 | A1 | * | 4/2002 | Wu et al. |

FOREIGN PATENT DOCUMENTS

| | | |
|---|---|---|
| EP | 1 043 557 | 10/2000 |

* cited by examiner

*Primary Examiner*—Scott Bushey
(74) *Attorney, Agent, or Firm*—Young & Thompson

(57) ABSTRACT

To reduce the level of oxygen concentration in the waste gases emitted by the stack of such installations, according to the invention, connecting means (15) connect the respective internal spaces of a chamber (13), for discharging an inert gas miscible with oxygen and of lower density than air, such as nitrogen, and of the stack (2); thus, this inert gas is mixed with at least the oxygen flowing through the stack and the mixture obtained is discharged with a velocity at least equal to approximately 7 m/s at the exit of the stack.

8 Claims, 1 Drawing Sheet

INSTALLATION AND METHOD OF VENTING THE WASTE GASES OF AIR DISTILLATION OR LIQUEFACTION UNITS

FIELD OF THE INVENTION

The present invention relates to an installation and a method for venting the waste gases of air distillation or liquefaction units and can especially be used in those of the said venting installations which comprise a stack, for example made of concrete, and a water-nitrogen tower.

In this text the word "oxygen" must be interpreted as comprising fluids containing at least 75 mol % oxygen and preferably at least 95 mol % oxygen, the word "nitrogen" must be interpreted as comprising fluids containing at least 90 mol % nitrogen, preferably at least 95 mol % nitrogen, and the word "argon" must be interpreted as comprising fluids containing at least 60 mol % argon.

BACKGROUND OF THE INVENTION

During implementation of air distillation and liquefaction processes, in units handling large amounts of air (substantially greater than or equal to 1000 tonnes per day) the water which is intended to cool the incoming air upstream of the purification units is itself cooled in a water-nitrogen tower, at the upper part of which the water is injected, by heat exchange with dry nitrogen. The resulting wet nitrogen is then continuously or at least almost continuously vented at the top of the tower. Moreover, for the venting of the contaminated or uncontaminated products coming from the air distillation or liquefaction, including oxygen, these are collected in a concrete stack and discharged via the top of the stack.

To make the venting installation more compact and facilitate its construction, it is possible to place the stack alongside the water-nitrogen tower.

Such a venting installation is drawn schematically in FIG. 1, which shows a cross section of this plant in a vertical plane.

In this FIG. 1, an installation for venting the waste gases from an air distillation or liquefaction unit comprises a water-nitrogen tower 1 and a stack 2 joined together by a common partition 3.

The water-nitrogen tower includes, near its base, a dry nitrogen feed pipe 11 and, in its upper part, a pipe 12 for feeding hot water to be cooled, which water is itself intended to then cool the air as mentioned above; thus, in the tower 1 the nitrogen follows a generally upwardly vertical path up to an upper chamber 13 having, at the top of it, an outlet 14 for discharging wet nitrogen into the atmosphere, whereas the cold water 16, pumped into the lower part of the tower, is sent to the units where it is brought into contact with the air to be cooled. The stack 2 includes, near its base, pipes for feeding waste gases to be discharged into the atmosphere, for example an air pipe 21, a nitrogen pipe 22 and an oxygen pipe 23; the stack 2 includes, near the top of it, a waste gas discharge outlet 24.

It may be noted that the wet nitrogen vented by the water-nitrogen tower 1 is discharged continuously. On the other hand, at various steps in the process it is possible that only a single waste gas is vented by the stack 2. The design of the stack must of course be chosen so that it is able to vent the three gases simultaneously, a situation which may occur; thus, the stack is designed to vent the gases with a total maximum flow rate corresponding to an exit velocity typically of about 20 m/s. However, this design is not devoid of drawbacks; if only a single gas is vented, because of the low flow rate, the venting velocity is very much less than the chosen value, in this case 20 m/s; this may have very unfortunate consequences if the single vented gas is oxygen: since oxygen is heavier than air, shortly after it has exited the stack there is a tendency for it to come back down towards the ground, and in certain weather conditions (for example when there is almost no wind), its level of concentration at ground level may locally become greater than 25%, which is excessive since it is dangerous especially on account of the oxidant properties of this gas.

SUMMARY OF THE INVENTION

The invention explained below remedies this drawback and for this purpose consists of an installation for venting the waste gases of an air distillation or liquefaction process, characterized in that it comprises a waste gas discharge stack emerging in the atmosphere and suitable for discharging in particular oxygen at least intermittently and means for reducing the level of oxygen concentration in the gases discharged by the stack, these possibly consisting of means for mixing an inert gas, miscible with oxygen and of lower density than oxygen under the same temperature and pressure conditions, preferably of lower density than air under the same temperature and pressure conditions, with the gases discharged.

Preferably, the installation comprises a chamber for almost permanently discharging into the atmosphere the inert gas miscible with oxygen and of lower density than air under the same temperature and pressure conditions, and means for connecting the respective internal spaces of the discharge chamber and of the stack in order to transfer at least some of the said inert gas into the stack so that the inert gas is mixed with at least the oxygen in the stack, and thus the level of oxygen concentration of the gases discharged by the stack is reduced.

By virtue of this arrangement, it is possible to appreciably reduce the level of oxygen concentration in the gas emitted at the outlet of the stack, even if only oxygen is introduced near the base of the stack.

The installation may furthermore have one or more of the following characteristics:

- the discharge chamber is a chamber forming part of a water-nitrogen tower;
- the inert gas is nitrogen or oxygen or air or a mixture of these gases;
- the discharge chamber forms part of a water-nitrogen tower placed alongside the stack, and the internal spaces in the chamber and in the stack are separated by a partition having, as means for connecting the internal spaces, an outlet for discharging, into the stack, the wet nitrogen contained in the chamber;
- the stack is equipped internally with a set of nozzles through which some or all of the gas introduced into the base of the stack flows;
- the connecting means comprise a discharge outlet provided in a partition separating the internal spaces in the chamber and in the stack, and the stack is equipped internally with a set of nozzles arranged in such a way that the top of it is at a level below the top of the discharge outlet;
- the discharge chamber belongs to a water-nitrogen tower having, near its base, a dry nitrogen feed pipe and, in its upper part, a pipe for feeding the hot water to be cooled, above the level of which a wet nitrogen discharge outlet, opening into the stack, is provided; and the stack includes, near its base, an air feed pipe and/or a nitrogen feed pipe and/or an oxygen feed pipe and/or a pipe for feeding another gas coming from the distillation.

The invention also consists of a method for venting oxygen-containing waste gases via a discharge outlet of a stack of an air distillation or liquefaction unit, characterized in that wet or dry nitrogen is mixed with at least the oxygen and the oxygen/nitrogen mixture obtained is discharged with a velocity at least equal to approximately 7 m/s at the discharge outlet.

As a variant:

the oxygen/nitrogen mixture obtained is discharged with a velocity at least equal to 10 m/s at the discharge outlet;

the oxygen/nitrogen mixture obtained is discharged with a velocity at least equal to approximately 12 m/s at the discharge outlet; or the oxygen/nitrogen mixture obtained is discharged with a velocity at least equal to approximately 20 m/s at the discharge outlet.

BRIEF DESCRIPTION OF THE DRAWINGS

Further features and advantages of the invention will become apparent from the following description of one embodiment of this invention, given by way of non-limiting example and illustrated by the accompanying drawings in which.

DETAILED DESCRIPTION OF THE INVENTION

Figures 1, 2:
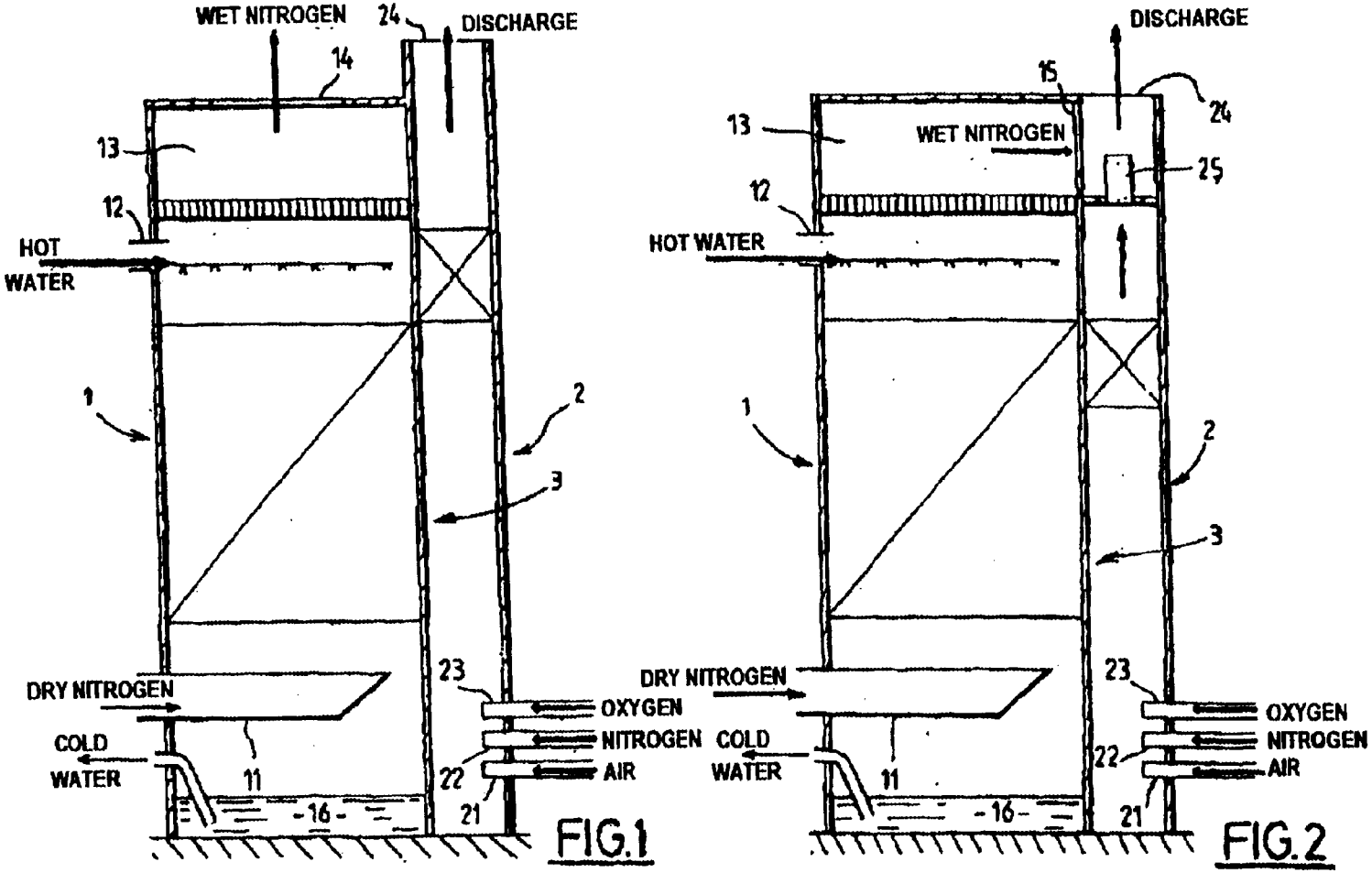
FIG.1 Prior Art
FIG. 1 is a schematic cross section of a prior art venting installation.
FIG. 2 is a schematic cross section through an installation according to the invention, in a vertical plane.

Those elements in FIG. 2 which correspond to elements in FIG. 1, already described, bear the same reference numbers.

In FIG. 2, the water-nitrogen tower 1 includes, near its base, a dry nitrogen feed pipe 11 and, in its upper part, a pipe 12 for feeding the hot water to be cooled, which water is itself intended then to cool the air flowing in the unit; thus, in the tower the nitrogen firstly follows a generally vertical path up to the upper chamber 13; however, the top of the tower does not have a wet nitrogen discharge outlet; instead, a wet nitrogen discharge outlet 15 pierces the partition 3 common to the tower 1 and to the stack 2, for example near the top of the tower 1 and in any case of course above the level of the hot water feed pipe 12 in the chamber 13; thus, this outlet 15 opens into the upper part of the stack 2 and the nitrogen in the chamber 13 follows a path which terminates approximately horizontally; as previously, the cold water 16 is directed towards the units where it is brought into contact with the air to be cooled. Also as previously, stack 2 includes, near its base, pipes for feeding the waste gases to be discharged into the atmosphere, namely in this case an air pipe 21, a nitrogen pipe 22 and an oxygen pipe 23; the stack 2 has, at the top of it, in this case approximately at the same level as that of the tower 1, a discharge outlet 24. Furthermore, the stack 2 is equipped internally, approximately level with the wet nitrogen discharge outlet 15, with a set of nozzles 25, the top of which is at a level below the top of the discharge outlet 15, in such a way that, whatever the gas introduced into the base of the stack 2, on the one hand it has passed through the set of nozzles 25 before reaching the top of the wet nitrogen discharge outlet 15 and, on the other hand, it is at least partially, and if possible completely, mixed with wet nitrogen before reaching the discharge outlet 24 of the stack; in addition, the set of nozzles 25 is designed, on the one hand, to allow preferably the total inflow to be discharged and, on the other hand, to obtain, at the discharge outlet 24 of the stack 2, in the case of an initial inflow of oxygen alone, a discharge velocity of at least about 7 m/s, preferably of at least 10 m/s, advantageously at least 12 m/s and better still, at least 20 m/s. As a variant, the nozzles thus defined allow, of course, an inflow of less than the total inflow to pass through them, the rest of the inflow therefore having been discharged via intermediate discharge means.

Thus, the wet nitrogen leaving the tower 1 via the discharge outlet 15, the density of nitrogen being lower than that of air, entrains, upwards, the stream of gas coming from the base of the stack, while still being mixed with this stream of gas. In addition, the continuous purging of the venting stack with nitrogen, or the nitrogen mixture, provides protection against all the impurities emanating from outside. Furthermore, by virtue of the continuous mixing of the outgoing nitrogen with the initially almost pure oxygen from the installation, over oxygenation of the air is prevented and the risk of the concentration of gaseous oxygen in the air at ground level rising above about 25% is reduced. Finally, although in conventional installations the water-nitrogen towers rarely need to be more than about twelve meters in height, whereas the discharges from the stacks usually require them to be from about 16 meters to 18 meters in height, by virtue of the under oxygenation of the mixture discharged it is possible to reduce the height of the stack to the height of the water-nitrogen tower, i.e. about twelve meters.

Of course, the invention is not limited to the illustrated embodiment described above, and it would be possible to provide other embodiments thereof without departing from its scope, and especially provision may be made to use the invention in installations which do not have a water-nitrogen tower but in which there is an excess of waste nitrogen (for example impure nitrogen or, more generally, nitrogen that cannot be utilized as such) which is transferred into a venting chamber, or else to mix oxygen not with nitrogen but with another gas which is miscible with it and of lower density than air, provided that this gas is inert, at least under the operating conditions, that is to say in particular that it is neither toxic nor explosive, and not either a fuel or an oxidizer, by itself or when mixed with oxygen. As a variant, it is also possible to provide a water-nitrogen tower 1 whose upper chamber 13 has at the top of it, as shown in FIG. 1, a discharge outlet 14 via which the gas or gases from the stack 2 would be discharged, although this technique would be slightly less effective in terms of dilution.

What is claimed is:

1. Installation for venting waste gases of an air distillation or liquefaction process, which comprises:

a water-nitrogen tower having an upper discharge chamber;

a waste gas discharge stack emerging in the atmosphere and suitable for discharging oxygen at least intermittently; and means for reducing the level of oxygen concentration in gases discharged by the stack by mixing an inert gas, miscible with oxygen and of lower density than oxygen under the same temperature and pressure conditions with the gases discharged.

2. The installation according to claim 1, further comprising connecting means for fluidly connecting the respective internal spaces of the discharge chamber and of the stack in order to transfer at least some of the inert gas into the stack so that the inert gas is mixed with at least the oxygen in the stack, and thus the level of oxygen concentration of the gases discharged by the stack is reduced.

3. The installation according to claim 1, wherein the inert gas is nitrogen, argon, air or a mixture of these gases.

4. The installation according to claim 2, wherein the water-nitrogen tower is positioned alongside the stack, and the internal spaces in the discharge chamber and the stack are separated by a partition having as the connecting means, an outlet for discharging into the stack wet nitrogen contained in the discharge chamber.

5. The installation according to claim 1, wherein the stack is equipped internally with a set of nozzles through which some or all of the gas introduced into the base of the stack flows.

6. The installation according to claim 2, wherein the connecting means comprise a discharge outlet provided in a partition separating the internal spaces of the discharge chamber and of the stack; and the stack is equipped internally with a set of nozzles having a top which is located at a level below the top of the discharge outlet.

7. The installation according to claim 1, wherein the water-nitrogen tower has, near its base, a dry nitrogen feed pipe; in its upper part, an inlet pipe for feeding hot water to be cooled; and positioned above the inlet pipe, a wet nitrogen discharge outlet opening into the stack.

8. The installation according to claim 1, wherein the stack includes, near its base, at least one of an air feed pipe, a nitrogen feed pipe, an oxygen feed pipe, and a pipe for feeding another gas coming from the distillation.

* * * * *